US005085599A

United States Patent [19]

Maejima et al.

[11] Patent Number: 5,085,599

[45] Date of Patent: Feb. 4, 1992

[54] CONNECTOR

[75] Inventors: Toshiro Maejima; Kazuaki Sakurai; Seiji Kozono; Mitsuhiko Totsuka; Toshiharu Kudo, all of Shizuoka, Japan

[73] Assignee: Yazaki Corporation, Tokyo, Japan

[21] Appl. No.: 699,014

[22] Filed: May 13, 1991

[30] Foreign Application Priority Data

May 16, 1990 [JP] Japan ..... 2-124208

[51] Int. Cl.[5] ..... H01R 13/40

[52] U.S. Cl. ..... 439/595; 439/598; 439/752

[58] Field of Search ..... 439/592, 595, 598, 752

[56] References Cited

U.S. PATENT DOCUMENTS

| | | | |
|---|---|---|---|
| 3,487,355 | 12/1969 | Cairns | 339/176 |
| 3,501,736 | 3/1970 | Norris | 339/91 |
| 3,601,760 | 8/1971 | Cairns | 339/91 |
| 4,431,252 | 2/1984 | Cairns | 339/176 MP |
| 4,758,182 | 7/1988 | Anbo et al. | 439/598 |
| 4,944,695 | 7/1990 | Tsuji et al. | 439/595 |
| 4,959,023 | 9/1990 | Watanabe et al. | 439/595 |
| 4,975,082 | 12/1990 | Nagasaka et al. | 439/598 |

FOREIGN PATENT DOCUMENTS

| | | |
|---|---|---|
| 51-109887 | 9/1976 | Japan . |
| 52-45083 | 4/1977 | Japan . |
| 61-7875 | 1/1986 | Japan . |
| 61-204375 | 12/1986 | Japan . |
| 62-47979 | 3/1987 | Japan . |
| 1348549 | 8/1971 | United Kingdom . |

*Primary Examiner*—Paula A. Bradley

*Attorney, Agent, or Firm*—Sughrue, Mion, Zinn, Macpeak & Seas

[57] ABSTRACT

A connector is disclosed wherein a flexible retaining piece for engagement with a terminal is disposed in a terminal receiving chamber of a housing body, and a spacer for preventing the flexing of the flexible retaining piece is inserted into a gap which allows the flexing of said flexible retaining piece. The abutment wall is provided in the housing body in opposed relation to a side surface of the flexible retaining piece. The spacer is provided in the gap so as to slide in a direction perpendicular to the side surface of the flexible retaining piece. Engaging holes and flexure prevention portions for the flexible retaining pieces are provided on the spacer and are arranged in the direction of slide of the spacer.

5 Claims, 3 Drawing Sheets

CONNECTOR

BACKGROUND OF THE INVENTION

This invention relates to a connector of the type in which flexible retaining pieces for retaining terminals received in a housing body are locked by the insertion of a spacer, thereby preventing rearward withdrawal of the terminals.

FIG. 6 is a vertical cross-sectional view of a conventional connector disclosed in U.S. Pat. No. 4,431,252.

In this connector 29, flexible retaining pieces 32 are disposed in respective terminal receiving chambers 31 of a housing body 30 in such a manner that these flexible retaining pieces are directed toward an end opening 33. The flexible retaining piece 32 is engaged in a retaining hole 35 in a terminal 34 inserted into the terminal receiving chamber 31, and in this condition a spacer 39 is inserted from the end opening 33 into a gap 38 between a back surface 36 of the flexible retaining piece 32 and an inner wall 37 of the housing body 30 to prevent the flexible retaining piece 32 from being flexed in a direction facing the back surface 36, thereby firmly retaining the terminal 34. In this Figure, the upper terminal 34' is in an incompletely inserted condition, and the flexible retaining piece 32 is flexed in the direction facing the back surface 36. The above conventional connector 29, however, has a problem that when the operator pushes the spacer 39 almost forcibly in a direction of arrow b without noticing such incomplete insertion, the flexible retaining piece 32 is flexed and deformed in the direction facing the back surface 36, and is finally broken. When the flexible retaining piece 32 is broken, the housing body 30 itself can not be used any longer, and much time is needed for re-assembling, thus worsening the productivity. Further, there is a risk that the connector having such forcibly-inserted spacer and the broken flexible retaining piece 32 may be regarded as a proper product, and is sent to the market.

SUMMARY OF THE INVENTION

With the above problem in view, it is an object of this invention to provide a connector in which even when a spacer is forcibly inserted in an incompletely-inserted condition of a terminal, a flexible retaining piece will not be broken, and such incompletely-inserted condition of the terminal can be detected.

The above and other objects have been achieved by a connector wherein a flexible retaining piece for engagement with a terminal is disposed in a terminal receiving chamber of a housing body, and a spacer for preventing the flexing of said flexible retaining piece is inserted into a gap which allows the flexing of the flexible retaining piece; wherein an abutment wall is provided in the housing body in opposed relation to a side surface of the flexible retaining piece; the spacer is provided in said gap so as to slide in a direction perpendicular to the side surface of the flexible retaining piece; and engaging holes and flexure prevention portions for the flexible retaining pieces are provided on the spacer, and are arranged in the direction of slide of the spacer.

In the incompletely inserted condition of the terminal, the flexible retaining piece remains flexed to be engaged in the engaging hole of the spacer. At this time, even if it is intended to forcibly slide the spacer in order to lock the flexible retaining piece, the inner surface of the engaging hole is engaged with the side surface of the flexible retaining piece, and the flexible retaining piece is engaged with the abutment wall of the housing body, so that the flexible retaining piece prevents the slide of the spacer without being deformed. Therefore, the incomplete insertion of the terminal can be detected.

DETAILED DESCRIPTION OF THE EMBODIMENTS

Figure 1:
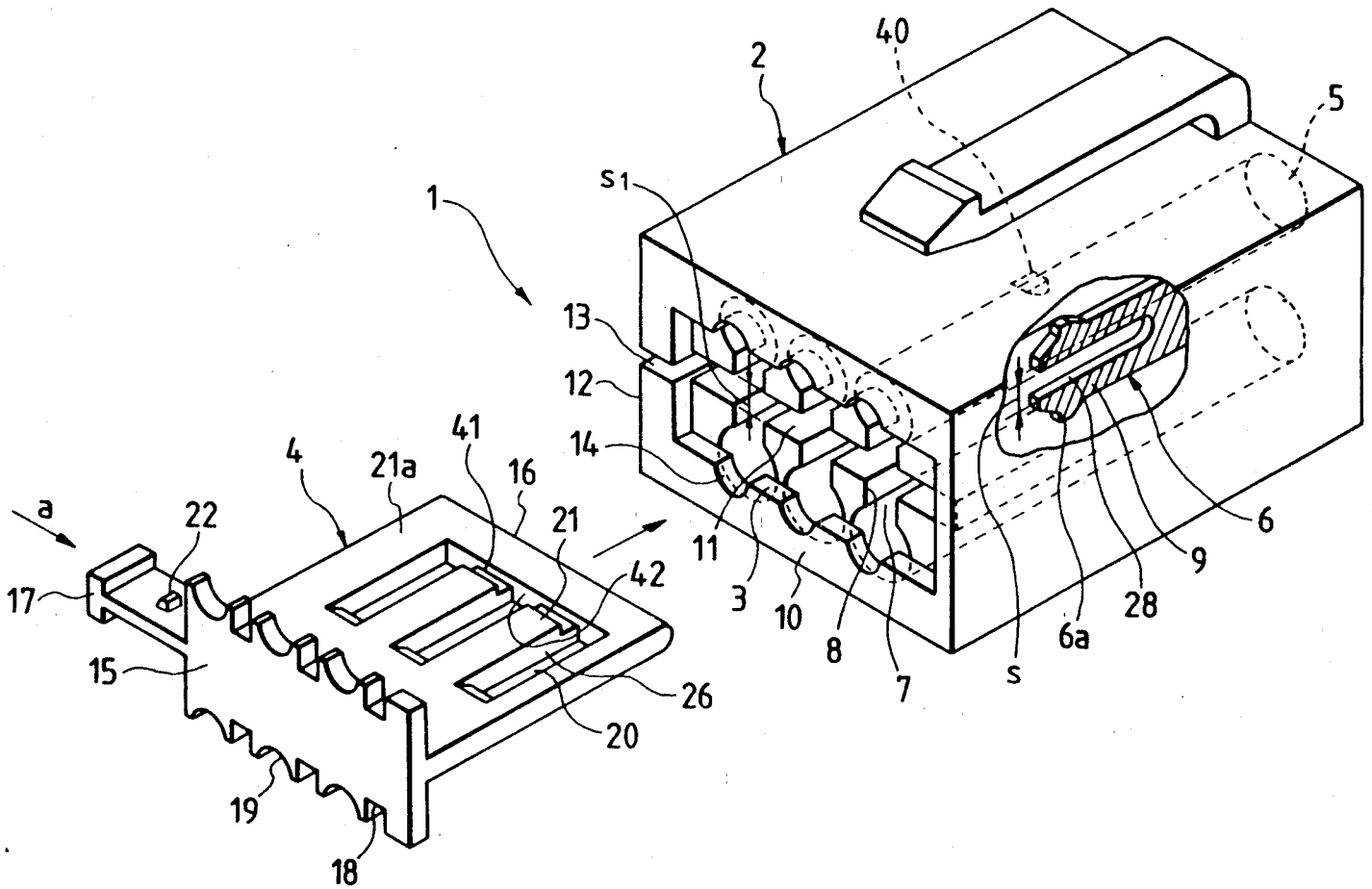
FIG. 1 is an exploded perspective view of a preferred embodiment of the invention.

FIG. 1 is an exploded perspective view of a connector according to the present invention.

A connector 1 comprises a housing body 2 of a synthetic resin, and a spacer 4 of a synthetic resin inserted into the interior of the housing body 2 from an open portion 3 thereof. Upper and lower rows of juxtaposed (three) terminal receiving chambers 5 are formed within the housing body 2, and a flexible retaining piece 6 is disposed in each of the terminal receiving chambers 5, each pair of upper and lower flexible retaining pieces 6 being arranged in a bifurcated manner. Each flexible retaining piece 6 is disposed in a vertical groove 7 communicating with each pair of upper and lower terminal receiving chambers 5. The flexible retaining piece 6 is urged at its projecting portion 6a by a terminal 25 (see FIG. 3) inserted into the terminal receiving chamber 5, and is flexed in a direction facing its back surface 28, and then is restored so as to cause the projecting portion 6a to engage in a step portion 25a of the terminal 25. Opposed inner surfaces 8 (see FIG. 4) of the vertical groove 7 are disposed in closely opposed relation to opposite side surfaces 9 of the flexible retaining piece 6, respectively.

A slit-like transverse groove 11 is formed in the housing body 2, and extends perpendicularly to the vertical grooves 7, the transverse groove 11 extending from the open portion 3 in a front wall 10 of the housing body 2. The width sl of the transverse groove 11 is almost equal to the gap a between the flexible retaining pieces 6 arranged in a bifurcated manner, and the transverse groove 11 leads to the gap a. Withdrawal prevention projections 40 for the spacer 4 are provided in the transverse groove 11. A notch 13 is formed in a side wall 12 of the housing body 2, and is communicated with the transverse groove 11. Semicircular holes 14 of a small size for the insertion of mating pin-like terminals (not shown) thereinto are formed in the open portion 3, and correspond to the terminal receiving chambers 5, respectively.

The spacer 4 has a lid portion 15 for closing the open portion 3, and a slide plate 16 extending perpendicularly from the central portion of the lid portion 15, the slide plate 16 being insertable into the transverse groove 11. The spacer 4 has an operating piece 17 formed on one side end thereof. Rectangular grooves 18 and semi-circular holes 19 are alternately formed in the lid portion 15, and the rectangular grooves 18 are brought into registry with the semicircular holes 14, respectively, when the spacer 4 is slidingly moved. Rectangular engaging holes 20 are formed through the slide plate 16 at equal intervals in the transverse direction (that is, in the direction a of slide of the spacer 4), and inner surfaces 26 of the engaging hole 20 are disposed adjacent to the side surfaces 9 of the flexible retaining piece 6, respectively. Plate portions 21 each between the adjacent engaging holes 20 and one-side plate portion 21a serve as flexure prevention portions for the back surface 28 of the flexible retaining piece 6. Insertion grooves 41 for the withdrawal prevention holes 40 are formed respectively at the ends of the plate portions 21, the insertion grooves 41 extending to the engagement holes 20. A retaining projection 22 for engagement with the notched portion 13 of the housing body 2 is formed on the operating piece 17.

Incidentally, a large notch may be formed in the side wall 12 of the housing body 2, in which case the spacer 4 is inserted from the side wall 12, so that the spacer 4 is sequentially retained provisionally and completely.

Figure 2:
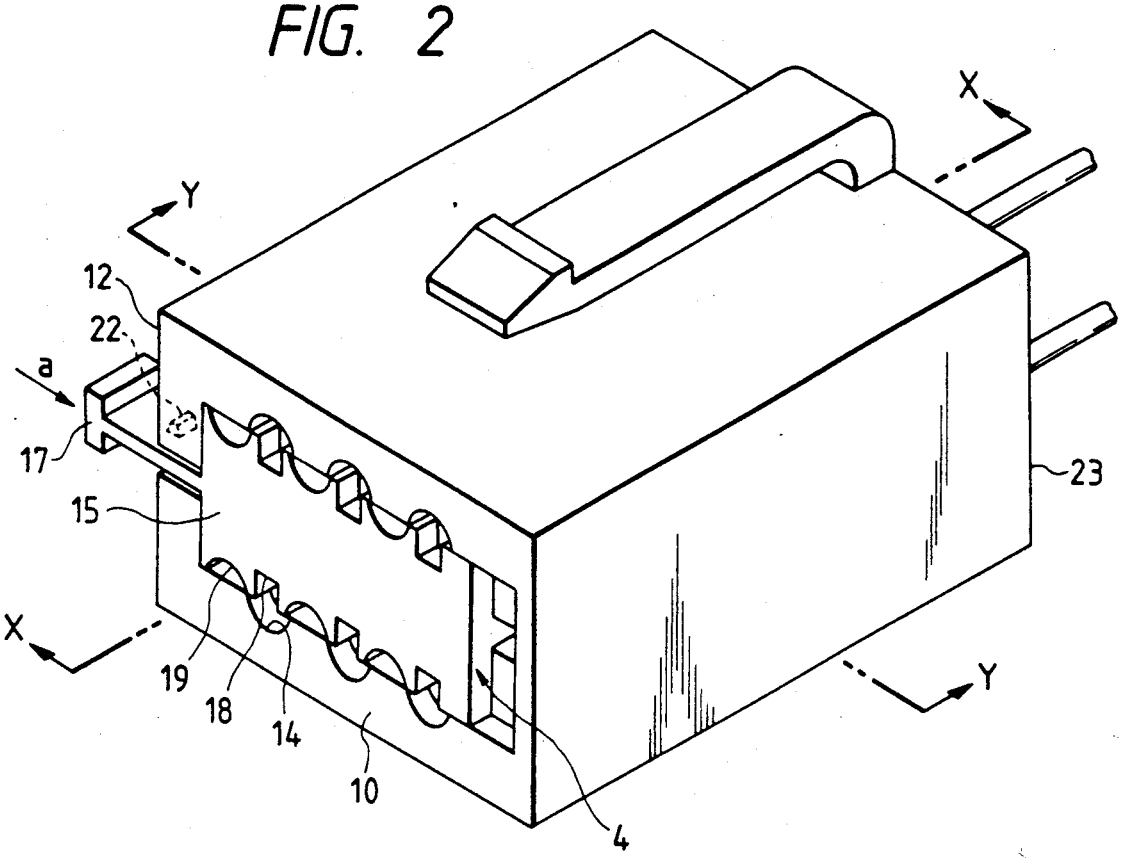
FIG. 2 is a perspective view of this embodiment in its assembled condition.

In FIG. 2, the slide plate 16 of the spacer 4 is inserted into the transverse groove 11 of the housing body 2 from the position forwardly of the housing body 2, and front end surfaces 42 of the engaging holes 20 (see FIG. 1) are engaged with the withdrawal prevention projections 40, respectively, and the lid portion 15 is engaged in the open portion 3 in such a manner that the lid portion 15 is displaced toward the notched portion 13, with the engaging projection 22 of the operating piece 17 engaged with the side wall 12. This is the provisionally-retained condition, and in this condition the semi-circular holes 14 in the front wall 10 are disposed in registry with the rectangular grooves 18, respectively, to enable a visual confirmation of the provisionally-retained condition of the spacer 4.

Figure 3:
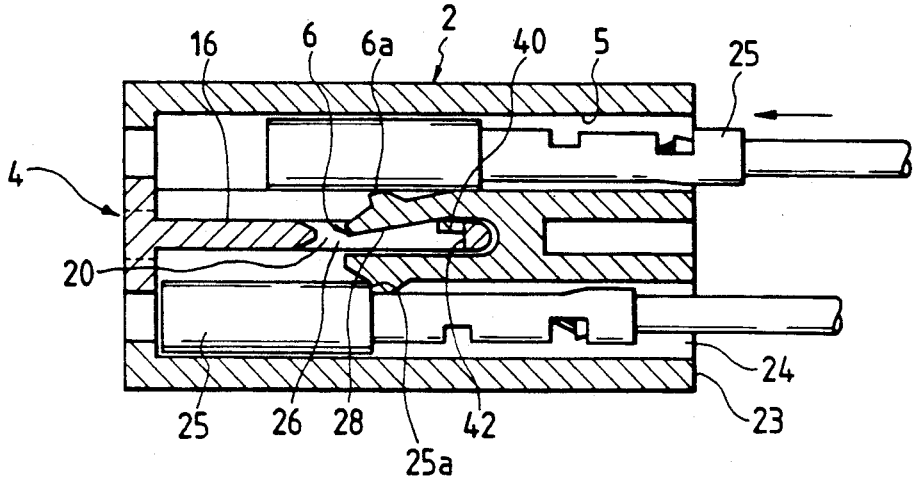
FIG. 3 is a cross-sectional view taken along the line X—X of FIG. 2.
Figure 4:
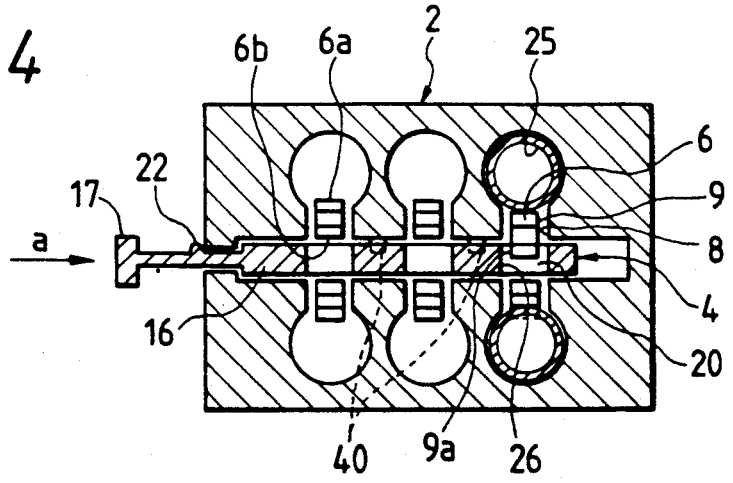
FIG. 4 is a cross-sectional view taken along the line Y—Y of FIG. 2.

FIG. 3 is a cross-sectional view taken along the line X—X of FIG. 2, and FIG. 4 is a cross-sectional view taken along the line Y—Y of FIG. 2. When the terminal 25 is being inserted into the terminal receiving chamber 5 from an open portion 24 in a rear wall 23, the flexible retaining piece 6 is urged at its projecting portion 6a by the terminal 25, so that a distal end portion 6b of the flexible retaining piece 6 is flexed into the engaging hole 20 of the slide plate 16 of the spacer 4. In this condition (that is, a so-called incompletely-inserted condition in which the insertion of the terminal 25 is stopped), even if it is intended to forcibly push the spacer 4 in the direction of arrow a (FIG. 4), the inner surface 26 of the engaging hole 20 of the slide plate 16 is engaged with one side surface 9a of the flexible retaining piece 6, and also the other side surface 9 of the flexible retaining piece 6 is engaged with the inner surface (abutment wall) 8 of the housing body 2. Thus, the spacer 4 is stopped, and therefore can not be inserted. Therefore, the incomplete insertion of the terminal 25 can be detected, and the flexible retaining piece 6 will not be broken.

Figure 5:
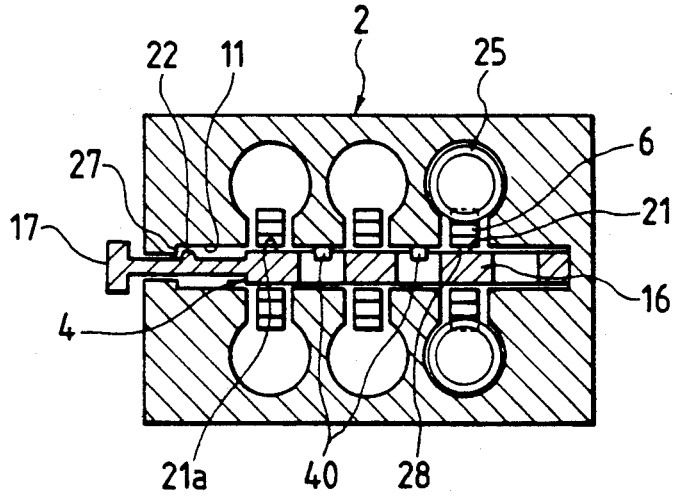
FIG. 5 is a cross-sectional view showing a completely retained condition of a spacer.
Figure 6:
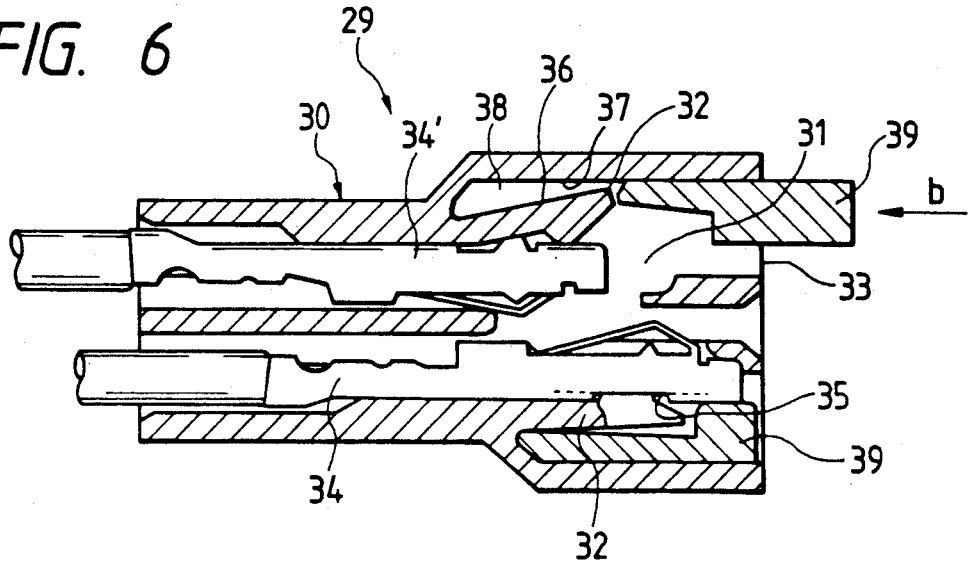
FIG. 6 is a vertical cross-sectional view of the prior art.

FIG. 5 shows the completely retained condition in which the terminal 25 is completely inserted, and the spacer 4 is inserted. The retaining projection 22 of the operating piece 17 is engaged with an inner surface 27 of the transverse groove 11, and the plate portions (flexure prevention portions) 21 and 21*a* of the slide plate 16 are disposed in opposed relation to the back surfaces 28 of the flexible retaining pieces 6 to prevent the flexible retaining piece 6 from being flexed in the direction facing the back surface 28, thereby firmly retaining the terminal 25.

As described above, in the present invention, in the condition in which the insertion of the terminal into the housing body is incomplete, even if the spacer is inserted almost forcibly, the flexible retaining piece will not be broken, thereby preventing such forcible insertion. Therefore, the incomplete insertion of the terminal can be detected. Therefore, a defective product is not allowed to be sent to the market. Further, the housing body will not be brought into an unusable condition, which would caused by the breakage of the flexible retaining piece as is the case with the prior art. Therefore, the time and labor for re- assembling is eliminated, and the productivity is improved.

We claim:

1. A connector wherein at least one flexible retaining piece for engagement with at least one terminal is disposed in an associated terminal receiving chamber of a housing body, and a spacer for preventing the flexing of said flexible retaining piece is inserted into a gap which allows the flexing of said flexible retaining piece, said connector comprising an improvement wherein an abutment wall is provided in said housing body in opposed relation to a side surface of said flexible retaining piece for contacting the latter when said retaining piece fails to engage with the associated terminal; said spacer is provided in said gap so as to slide in a direction perpendicular to said side surface of said flexible retaining piece; and engaging holes and flexure prevention portions for said flexible retaining pieces are provided on said spacer, and are arranged in the direction of slide of said spacer.

2. The connector according to claim 1, wherein said spacer includes a projection that is engaged with an associated portion formed in said housing body when every retaining piece is completely engaged with the associated terminal.

3. The connector according to claim 1, wherein said flexible retaining piece is bifurcated into two portions.

4. The connector according to claim 3, wherein said gap includes a slit extending in said direction perpendicular to said side surface of said flexible retaining piece.

5. The connector according to claim 4, wherein a distance between the two portions of said bifurcated retaining piece is substantially equal to a width of said slit.

* * * * *